US005211432A

United States Patent [19]

Lin

[11] Patent Number: 5,211,432

[45] Date of Patent: May 18, 1993

[54] LATCH UNIT FOR DOOR LOCKS

[76] Inventor: Jui C. Lin, No. 55-10 Been Chou Rd., Kangshan, Kaohsiung Hsien, Taiwan

[21] Appl. No.: 910,432

[22] Filed: Jul. 8, 1992

[51] Int. Cl.[5] ..... E05C 1/16

[52] U.S. Cl. ..... 292/169; 292/337; 292/DIG. 38

[58] Field of Search ..... 292/169, 1.5, 337, DIG. 38

[56] References Cited

U.S. PATENT DOCUMENTS

| | | | |
|---|---|---|---|
| 2,634,151 | 4/1953 | Russell et al. | 292/337 |
| 2,700,887 | 2/1955 | Oxhandler et al. | 292/337 X |
| 2,739,004 | 3/1956 | Russell | 292/337 |
| 3,133,757 | 5/1964 | James | 292/DIG. 38 X |
| 3,806,177 | 4/1974 | Rivadossi | 292/DIG. 38 X |
| 4,407,537 | 10/1983 | Ames | 292/337 |
| 4,676,084 | 6/1987 | Signorelli | 292/307 R X |
| 4,974,883 | 12/1990 | Jans | 292/169 |

*Primary Examiner*—Richard E. Moore

*Attorney, Agent, or Firm*—Jacobson, Price, Holman & Stern

[57] ABSTRACT

A latch unit having a cylindrical housing consisting of two half portions for containing a latch bolt, a moving member to retreat the latch bolt and a recovering member to push the latch bolt forward to an original position in which the latch bolt extends out of the housing.

7 Claims, 4 Drawing Sheets

LATCH UNIT FOR DOOR LOCKS

BACKGROUND OF THE INVENTION

Conventional door locks have a wide scope of difference in usage, function and strength. For example, those used in a door of a house to go in and out of the house should have a high standard of safety against burglary, but those used in doors of bathrooms, restrooms or bedrooms do not need such high standard. Conventional door locks are commonly made of metal material inspite of their different usage, to a resultant high cost in manufacture.

SUMMARY OF THE INVENTION

The object of this invention is to provide a latch unit to be used in a door lock not demanding high safety against burglary. To lower cost and to facilitate mass production, plastics is used as its material instead of metal to reduce waste.

The latch unit in the present invention comprises a cylindrical housing assembled with two half portions and having an inner chamber to dispose a latch bolt, an actuating wheel to retreat the latch bolt and a resilient member to push the latch bolt to an original position in which the latch bolt extends out of the housing.

BRIEF DESCRIPTION OF DRAWINGS

This invention will now be described in detail with reference to accompanying drawings wherein.

DETAILED DESCRIPTION OF THE INVENTION

Figure 1:
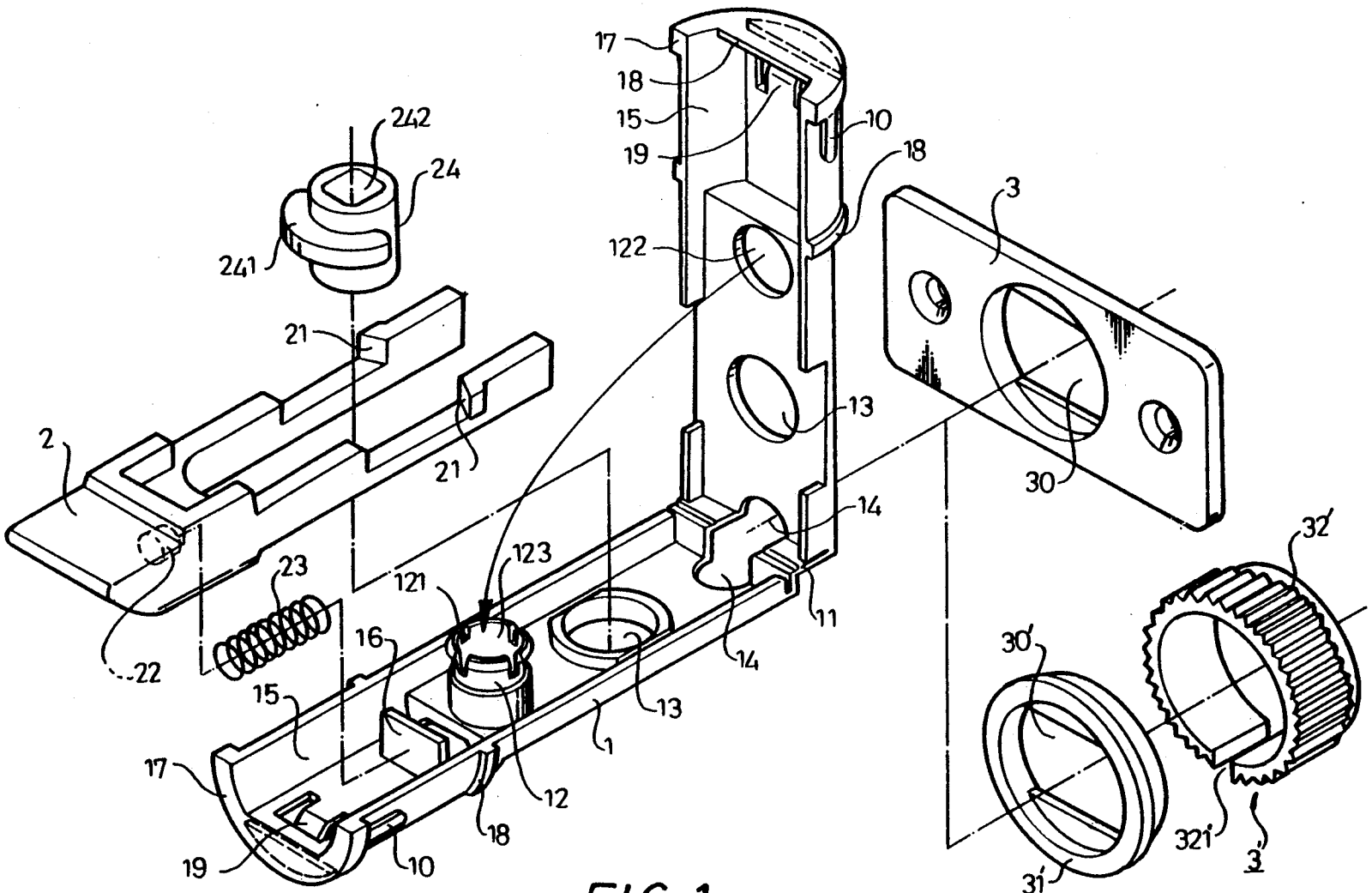
FIG. 1 is an exploded perspective view of a first embodiment of a latch unit in the present invention.

A first embodiment of a latch unit in the present invention, as shown in FIG. 1, comprises a cylindrical housing 1, a latch bolt 2 contained in the housing 1, and a locating member 3 or 3'.

The housing 1 is made of plastics, having a cylindrical shape, a bendable edge 11 at one end side so that the housing 1 can be separated into half portions to become an upper half portion and a lower half portion. The bendable edge 11 can also be provided in lengthwise direction instead of a side position. The housing 1 is porvided with an engaging member 12, a cone-shaped tubular post having petal-shaped notches 121 in the lower half portion and a locating hole 122 in the upper half portion for the cone-shaped post 12 to engage therein. But a conventional engaging member of a hook and a hole can also be used as the engaging member. For necessary function, the housing 1 is provided with two corresponding shaft holes 13 and two locating holes 14 in both the lower and the upper half portion, a locating hole 123 in the lower half portion and a locating hole 122 in the upper half portion. The shaft holes 13 are for an actuating wheel 24 to fit rotatably therein. The actuating wheel 24 has projecting curved teeth 241 to engage two teeth 21 in a latch bolt 2, and a shaft hole 242 for a square shaft in a lock to pass through. The locating hole 122 not only engages the cone-shaped tubular post 12, but also communicates with the hole 123 in the post 12 for a locating foot in a lock to pass through just as the locating holes 14 are for another locating foot to pass through.

When the housing 1 is in closed condition, a chamber 15 is formed for the latch bolt 2 to move therein, having an upright wall 16 for one end of a spring 23 to rest on. The other end of the spring 23 rests on a stud 22 in the latch bolt 2. Flanges 17 are also provided in the housing 1, surrounded by slots in the three sides so as to protrude outward and to have better flexibility of a hole 30 in the locating member 3 to pass over. Projections 10 are also provided on an outer surface of the housing 1 so as to prevent the ring 32 of the locating member 3 from approaching and pressing the resilient plate 19.

The latch bolt 2 has two teeth 21 to engage the teeth 241 in the actuating wheel 24 to retreat the latch bolt in the chamber 15 of the housing 1 by movement of the actuating wheel 24. The latch bolt 2 also has a stud 22 for one end of the spring 23 to rest on to push the latch bolt 2 out of the housing 1 when the teeth 241 in the actuating wheel 24 do not push the teeth 21 in the latch bolt 2.

The locating member 3 or 3' is either a plate 3 or two rings 31', 32'. The plate 3 or the ring 31' has a same hole 30 or 30' for the flange 17 of the housing 1 to pass through so that the plate 3 is positioned past the resilient plate 19, which stops the plate 3 from withdrawing to combine the plate 3 or the ring 31' with the housing 1 as one unit. And for convenience of adjusting the latch bolt 2 after it is assembled in a door, the ring 32' can be added in the locating member 3', having a slot 321' in the wall of the ring 32' to enable the ring to expand or reduce its diameter in order to easily fit around the housing 1. The ring 32' is limited to be located between the limit ridge 18 and the annular projection 10 so that the whole latch unit can be adjusted in relation to the ring 32'.

Figure 2:
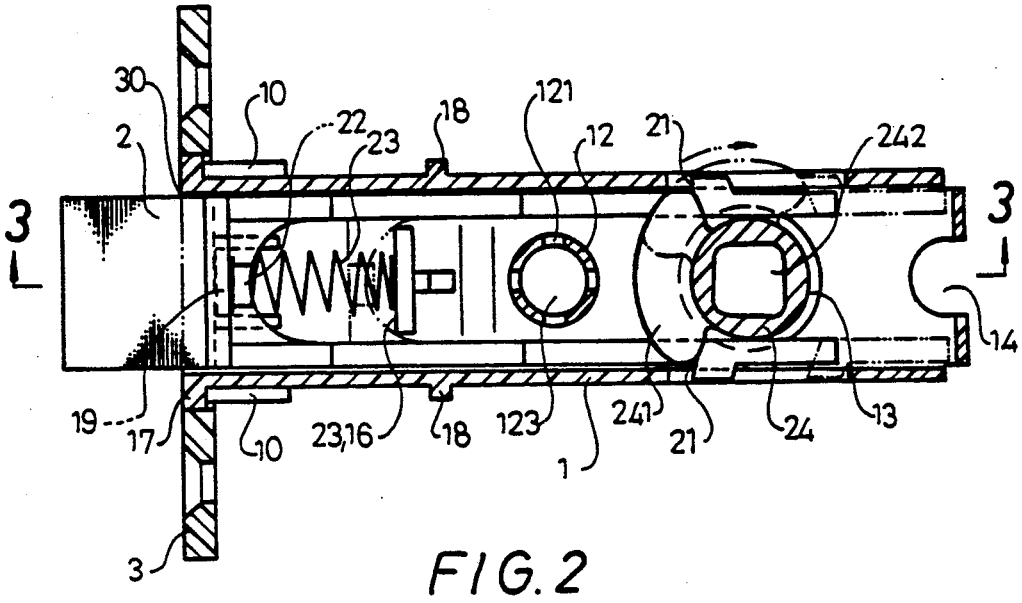
FIG. 2 is a cross-sectional view taken along line 2—2 of FIG. 3.
Figure 3:
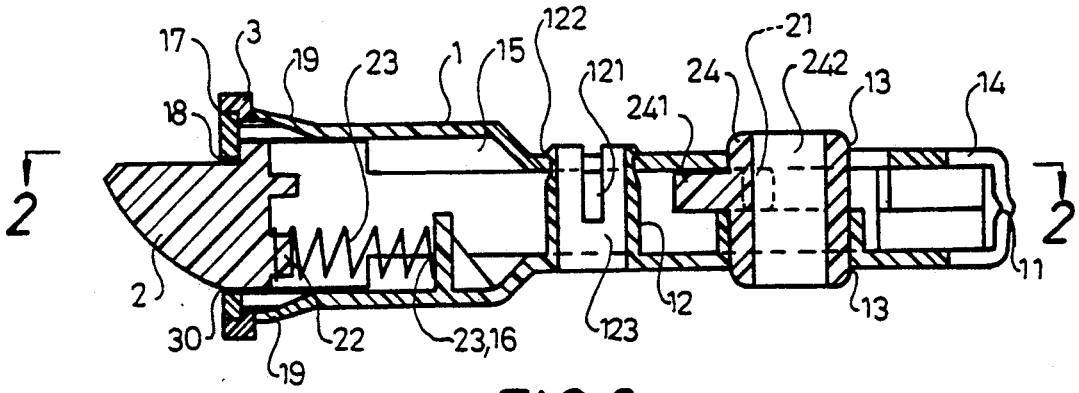
FIG. 3 is a cross-sectional view of a second embodiment of a latch unit in the present invention.

Referring to FIGS. 2 and 3 after the latch bolt 2, the actuating wheel 24 and the spring 23 are disposed in the housing 1, the housing 1 is to be kept in closed position by the tubular post 12 engaging the hole 122. Then the locating member 3 is to be fitted around the housing 1, with the flange 17 fitting with the hole 30 in the locating member 3 and with the resilient plate 19 located behind the locating member 3 preventing it from retreating out of the housing 1 and keeping the whole latch unit in assembled condition. In this position, the latch bolt 2 extends out of the housing 1 forced by the spring 23 and the two teeth 21 are in contact with both sides of the curved teeth 241. Then if the actuating wheel 24 is rotated whether clockwise or counterclockwise, the curved teeth 241 can push back one of the two teeth 21 to retreat the latch bolt 2 lengthwise into the chamber 15.

Figure 4:
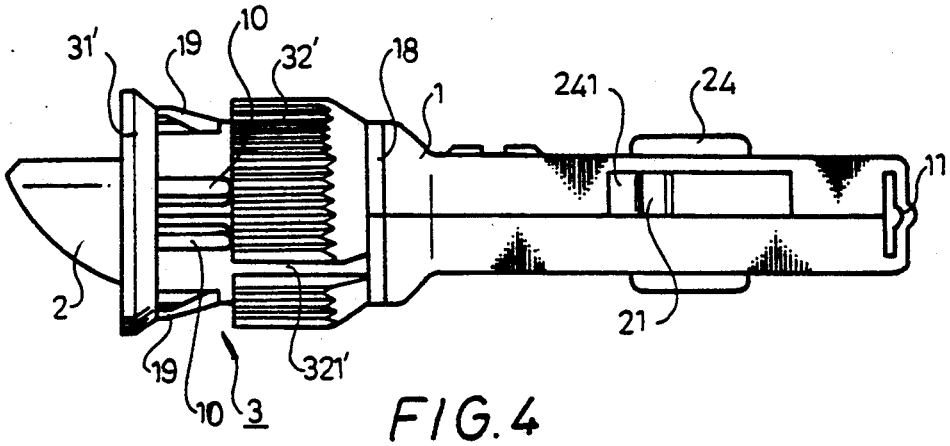
FIG. 4 is an upside view of a second embodiment of a latch unit in the present invention.

A second embodiment is shown in FIG. 4, having a locating member 3' consisting of two rings 31' and 32'. The ring 31' is kept in position by the resilient plate 19, and the ring 32' is kept in position between the projections 10 and the limit ridges 18. When the ring 32' is fixed in a hole in a door, the latch unit can still be adjusted in relation to the ring 32'. The rest components are the same as those in the first embodiment.

Figure 5:
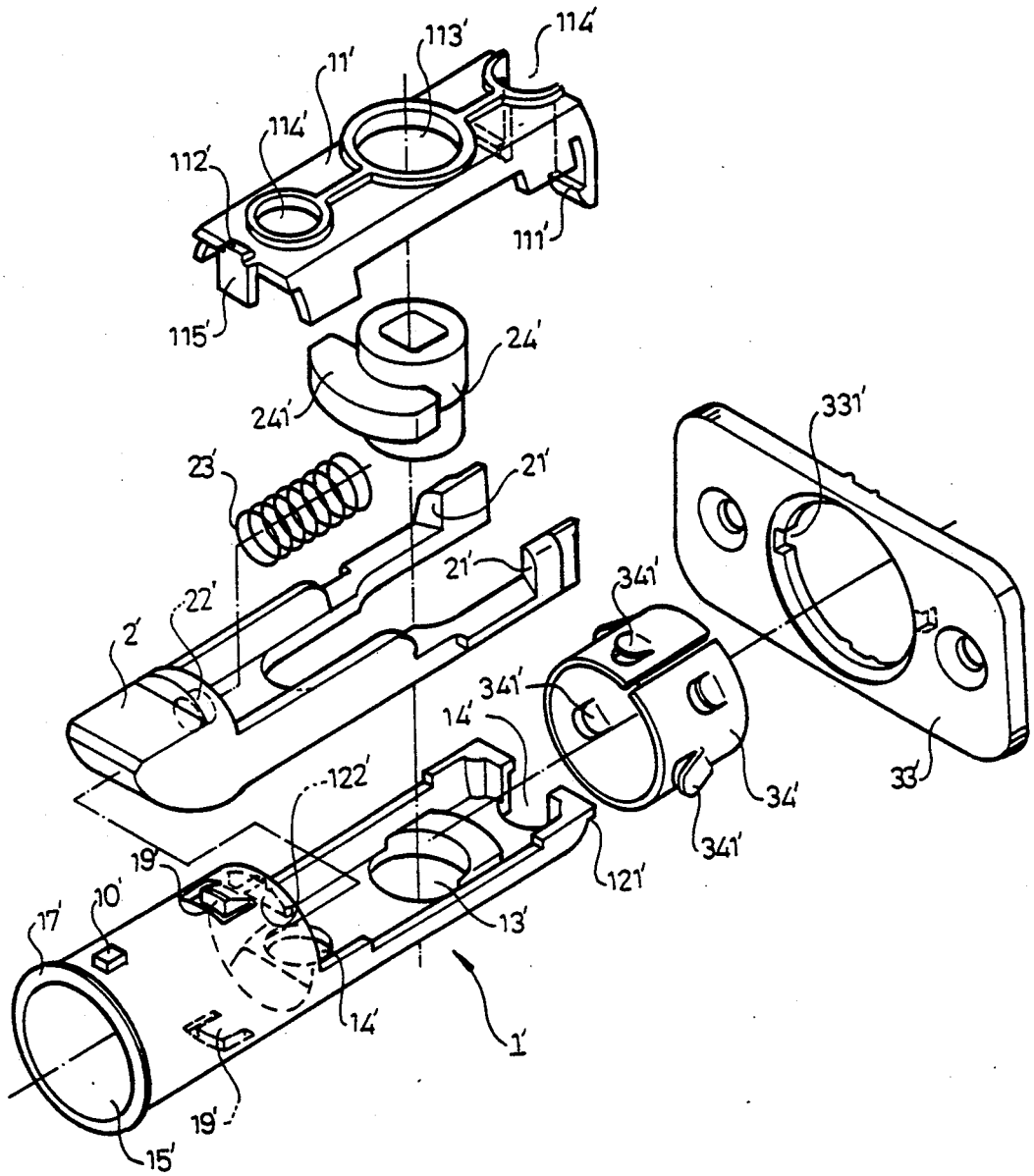
FIG. 5 is a exploded perspective view of a third embodiment of a latch unit in the present invention.
Figure 6:
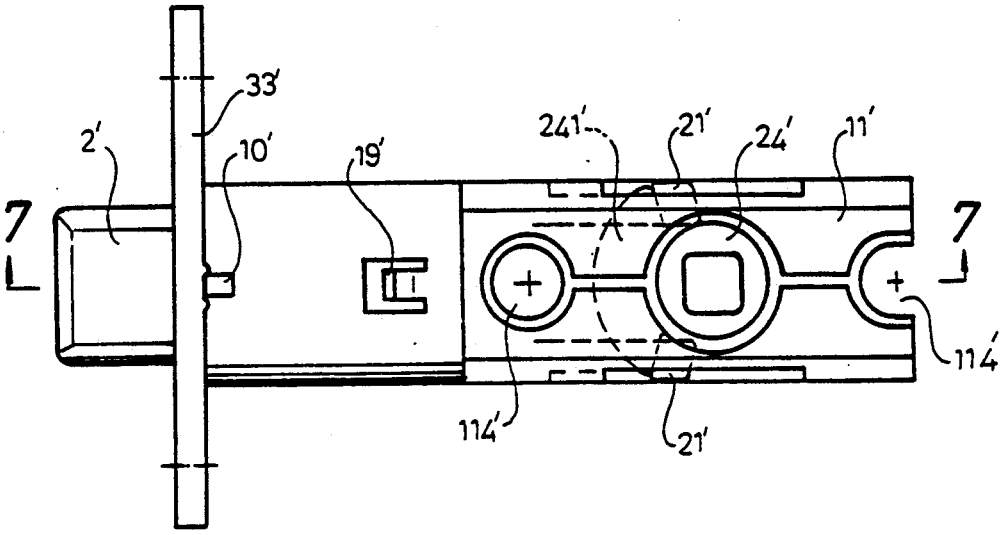
FIG. 6 is an upside view of the third embodiment of the latch unit in the present invention.
Figure 7:
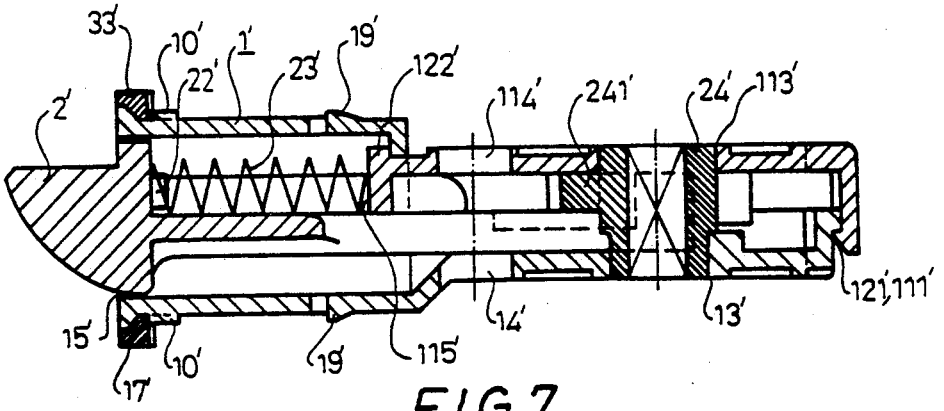
FIG. 7 is a cross-sectional view taken along line 7—7 of FIG. 6.
Figure 8:
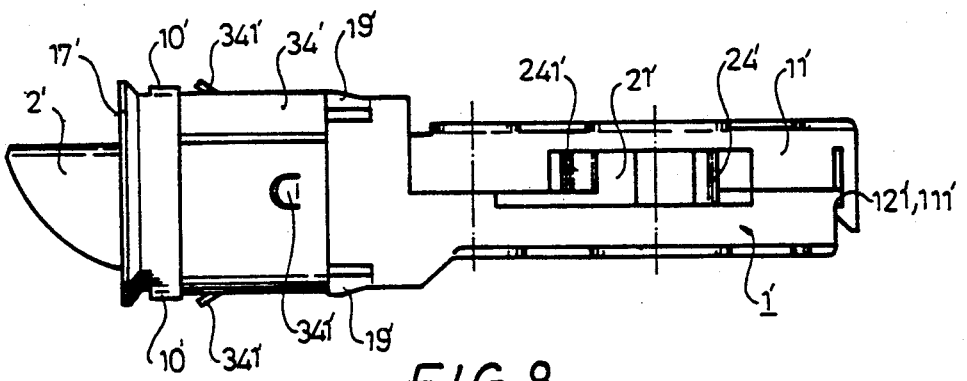
FIG. 8 is a side view of a fourth embodiment of the latch unit in the present invention.

A third embodiment is shown in FIG. 5, having a housing 1' different from those in the first and the second embodiment, which consists of a large portion formed with a cylindrical section and a rather flat section, and a small portion, an upper plate 11', to cover on the flat section of the large portion. The upper plate 11' has hooks 111', 112' to engage side edges 121', 122' of the large portion to combine the upper plate 11 with the large portion. The large portion has a shaft hole 13, and locating holes 14' to correspond to a shaft hole 113' and locating holes 114'. The shaft holes 113' are for the actuating wheel 24' to fit and rotate therein, and curved teeth 241 provided in the wheel 24' to push teeth 21' in a latch bolt 2'. The locating holes 14', 114' are for posts in a lock to pass through. An upright wall 115' is provided at one end of the upper plate 11' for one end of a spring 23' to hook at, which has the other end to hook at a stud 22' in the latch 2' so that the latch bolt 2' is usually pushed by the resilience of the spring 23' out of the cylindrical section of the housing 1' after the latch bolt is placed on a chamber 15'. A flange 17' is provided in the housing 1' at one end for locating member 33', 34' to combine with. The locating member 33' has a notch 331' in a circumferential edge of a hole for the locating member 33' to fit through a projection 10 around the housing 1 and then is rotated 90 degrees to let the locating member 33' blocked between the flange 17' and the projection 10, as shown in FIG. 6. The locating member 34' has one side edge contacting the projection 10' of the housing 1' and the other side edge resting on the resilient plate 19', fitting around the housing 1 as shown in FIG. 8.

The latch unit in the present invention has fewer components than a conventional one, having omitted such components as a latch cylinder, a front and a rear combining plates, an actuating plate. In addition, plastics is used as material to cut down the cost, and its strength is enough to be used in a door inside a house for bathrooms, restrooms, etc.

What is claimed is:

1. A latch unit for door locks comprising a cylindrical housing, a latch bolt, and an actuating wheel, said housing comprising an upper portion and a lower portion assembled together to define a chamber for containing the latch bolt, the latch bolt being provided with two teeth, said actuating wheel being disposed in two shaft holes in said housing and having a curved tooth and a square hole for a square shaft to pass through to permit said wheel to rotate, said curved tooth of the actuating wheel having opposite ends for engaging said two teeth of said latch bolt so that said latch bolt may be moved rearwardly in said housing by rotation of said actuating wheel, a spring being provided in the chamber for urging the latch bolt forwardly when the actuating wheel is in a neutral position in which the two teeth of the latch bolt do not engage the curved tooth of the actuating wheel but are located adjacent the ends of the curved tooth, wherein a locating member is provided to fit around said assembled housing, having a hole to fit around a flange of the housing and keeping the housing in closed position firmly with help of a resilient plate provided on the housing pushing against the locating member.

2. A latch unit for door locks comprising a cylindrical housing, a latch bolt, and an actuating wheel, said housing comprising an upper portion and a lower portion assembled together to define a chamber for containing the latch bolt, the latch bolt being provided with two teeth, said actuating wheel being disposed in two shaft holes in said housing and having a curved tooth and a square hole for a square shaft to pass through to permit said wheel to rotate, said curved tooth of the actuating wheel having opposite ends for engaging said two teeth of said latch bolt so that said latch bolt may be moved rearwardly in said housing by rotation of said actuating wheel, a spring being provided in the chamber for urging the latch bolt forwardly when the actuating wheel is in a neutral position in which the two teeth of the latch bolt do not engage the curved tooth of the actuating wheel but are located adjacent the ends of the curved tooth, wherein the upper portion and the lower portion of said housing are joined together along a bendable edge, an engaging member and locating holes being respectively proved in both portions, and said engaging member in the lower portion comprising a post provided with several petal-shaped notches to fit in the locating hole in the upper portion to fix both the portions firmly together.

3. The latch unit as claimed in claim 1, wherein said chamber in the cylindrical housing has an upright wall for one end of the spring to rest on so that the other end of the spring can always push said latch bolt.

4. A latch unit for door locks comprising a cylindrical housing, a latch bolt, and an actuating wheel, said housing comprising an upper portion and a lower portion assembled together to define a chamber for containing the latch bolt, the latch bolt being provided with two teeth, said actuating wheel being disposed in two shaft holes in said housing and having a curved tooth and a square hole for a square shaft to pass through to permit said wheel to rotate, said curved tooth of the actuating wheel having opposite ends for engaging said two teeth of said latch bolt so that said latch bolt may be moved rearwardly in said housing by rotation of said actuating wheel, a spring being provided in the chamber for urging the latch bolt forwardly when the actuating wheel is in a neutral position in which the two teeth of the latch bolt do not engage the curved tooth of the actuating wheel but are located adjacent the ends of the curved tooth, wherein the lower portion of said cylindrical housing is formed of a cylindrical section and a flat section and the upper portion of the housing comprises a flat portion on the flat section of the lower portion, said lower portion and said upper portion being kept together by means of hooks and side edges, two corresponding shaft holes and two locating holes being respectively provided in said lower portion and said upper portion for the actuating wheel to fit and rotate therein, said cylindrical section of said lower portion being for the latch bolt to be located therein.

5. The latch unit as claimed in claim 4, wherein said upper portion of the housing has a projecting wall for one end of said spring to rest thereon so that the other end of the spring may push forward said latch bolt.

6. The latch unit as claimed in claim 1, wherein said locating member consists of two rings, one of said rings having a hole to fit around the flange of said housing and to be pushed by the resilient plate of said housing, and the other of said rings being located to fit between a projection and an annular ridge on said housing.

7. A latch unit for door locks as claimed in claim 1 wherein the housing is made of plastics.

* * * * *